US005533835A

United States Patent [19]

Angelette

[11] Patent Number: 5,533,835

[45] Date of Patent: Jul. 9, 1996

[54] RAILROAD CROSSING SIGNAL FOUNDATION AND METHOD OF PRODUCING AND ERECTING THE SAME

[76] Inventor: A. M. Angelette, 4160 Ewing Rd., Austell, Ga. 30001

[21] Appl. No.: 383,944

[22] Filed: Feb. 6, 1995

[51] Int. Cl.[6] ..... E02D 5/74; E02D 5/10; E02D 5/34

[52] U.S. Cl. ..... 405/229; 52/296; 405/239; 405/244; 405/256

[58] Field of Search ..... 405/229, 239, 405/233, 244, 256; 52/DIG. 7, 98, 295, 296

[56] References Cited

U.S. PATENT DOCUMENTS

| | | | |
|---|---|---|---|
| 178,438 | 6/1876 | Hill . | |
| 621,027 | 3/1899 | Callaway . | |
| 1,447,942 | 3/1923 | Fitzgerald . | |
| 1,529,895 | 7/1924 | Chance et al. . | |
| 2,282,251 | 5/1942 | Schwendt . | |
| 2,282,452 | 5/1942 | Brown . | |
| 2,367,146 | 1/1945 | Siebs . | |
| 2,381,014 | 8/1945 | Thornley . | |
| 2,917,901 | 12/1959 | Lackner . | |
| 3,219,308 | 11/1965 | Halstead . | |
| 3,331,496 | 7/1967 | Marsden et al. . | |
| 3,617,047 | 11/1971 | Holt | 269/121 |
| 3,945,601 | 3/1976 | Rowley | 249/48 |
| 4,434,600 | 3/1984 | Backman | 52/741 |
| 4,592,678 | 6/1986 | McNinch, Jr. et al. | 405/284 |
| 4,704,052 | 11/1987 | Aubert | 405/229 |
| 4,817,353 | 4/1989 | Woods et al. | 52/295 |
| 4,972,641 | 11/1990 | Barrios | 52/295 |
| 5,257,489 | 11/1993 | Angelette | 52/295 |

FOREIGN PATENT DOCUMENTS

| | | |
|---|---|---|
| 8004538 | 11/1980 | Netherlands . |

*Primary Examiner*—David J. Bagnell
*Assistant Examiner*—Tara L. Mayo
*Attorney, Agent, or Firm*—Kennedy & Kennedy

[57] ABSTRACT

A railroad crossing signal foundation has upright guide rods (19) to which an upper frame member (14) and a lower frame member (15) are mounted. A concrete reinforcement gridwork (16,17) is supported on the lower frame. After erection in a ground hole, concrete is poured into the hole to a fill plane defined by the upper frame member (14) so as to embed the frame member and gridwork and a portion of the guide rods located below the fill plane.

12 Claims, 3 Drawing Sheets

RAILROAD CROSSING SIGNAL FOUNDATION AND METHOD OF PRODUCING AND ERECTING THE SAME

TECHNICAL FIELD

This invention relates generally to foundations for railroad crossing signal and traffic control devices, and to methods of producing and erecting such foundations.

BACKGROUND OF THE INVENTION

Railroad crossings have long existed where automotive roads and highways cross railroad tracks. In early times, railroad crossing signs were posted to warn automotive vehicle drivers of railroad crossings to avoid the possibility of collisions. In later times, such signs were made larger and equipped with flashing lights which were activated upon the approach of a train. At major railroad crossings, barrier bars were installed that automatically raised and lowered in response to the approach and passing of trains. With the addition of such flashing lights, barrier bars, and other warning equipment, the foundations of railroad crossing signals have needed to provide stronger support in the ground aside railroad crossings. In addition, advances in communications technologies have created an increased need for railroad crossing signals to be installed in such a manner as to avoid damage to various preexisting underground obstacles including utility and communications lines, pipes, wires, and cables located in the ground alongside railroad tracks.

A number of construction methods have heretofore been employed to erect railroad crossing signal foundations. Precast foundations have been laid into holes in the ground aside railroad tracks. Such precast railroad signal foundations have been made and installed as unitary structures and also as in-ground assembled modules.

Poured concrete foundations have also been formed on the job site by digging a hole aside the railroad crossing, erecting a wood molding frame to contain poured concrete about the perimeter of the hole, and then pouring concrete into the frame. Metal cages, alone and in concert with wood boards, have also been embedded inside the concrete to provide additional support. The poured concrete foundations have been formed by pouring concrete continuously into a large wooden mold or by pouring concrete at separate intervals into separate layered molds one on top of the other over a period of time as the drying time of each layer allows. Once the poured concrete has set, the wood molding frames are normally removed prior to back-filling the holes with dirt around the poured foundation. However, workers in the field often do not in fact remove the wood frames, due to lack of discipline or a desire to cut corners, and the workers simply back-fill dirt on top of the wood frames rather than properly removing the wood frames. The failure to remove these wood frames creates the risk of instability of the foundation since the wood frames eventually rot in the ground against the foundation causing deterioration of foundation support and crumbling of adjacent earth walls.

Foundations of the types just described have proven costly to construct and not adapted to accommodate preexisting underground utility and communication lines. Installation of a poured concrete foundation with a mold requires considerable set up time and take down time for the wood mold frames. Also, prior to back filling the hole of poured concrete foundations or mounting signal support structures thereon, the concrete must set. If the concrete is poured in distinct layers, the drying time is further increased since each layer must dry before the next layer is poured. Indeed, it often takes up to three days to construct such poured concrete foundations during which time the hole remains open thereby creating a danger to passersby and exposing the drying concrete to outside elements which can lead to icing complications. Furthermore, both precast and in-situ poured concrete foundations have not been made to be readily adaptable at the job site to avoid disruption of preexisting underground utility and communications lines and pipes. This too has caused escalation in installation time and increased costs in order to avoid damaging the underground lines and pipes.

Accordingly, it is seen that a railroad crossing and traffic control signal foundation has long remained needed that may be produced and constructed in an adaptable, safe and cost efficient manner. It is to the provision of such therefore that the present invention is primarily directed.

SUMMARY OF THE INVENTION

In a preferred form of the invention, a method of constructing a railroad crossing signal foundation comprises the steps of digging a hole in the ground adjacent a railroad track and mounting a metallic anchoring and reinforcing framework having guide rods in the hole with the guide rods extending uprightly above a selected concrete fill plane. Concrete is poured into the hole to the fill plane to substantially embed the metallic framework in the concrete leaving a portion of the guide rods extending above the fill plane exposed to which a railroad crossing signal or signal support may be mounted upon the setting of the concrete. Where a preexistent obstacle is unearthed in digging the hole, such as a preexisting utility or communications line, pipe or cable, then, prior to pouring the concrete, such is protected from damage by placing a protective shield thereabout.

In another preferred form of the invention, a railroad crossing signal foundation comprises a plurality of guide rods and an upper frame member and a lower frame member adjustably mounted on the guide rods. A concrete reinforcement gridwork is supported on the lower frame member. A concrete block substantially embeds the upper frame member, the lower frame member, the reinforcement gridwork and a lower portion of the guide rods. The height of the lower frame member and gridwork supported thereon is adjustable to a desired reinforcement position. The height of the upper frame member is adjustable to provide a concrete fill plane with the guide rods extending above the fill plane being exposed to which a railroad crossing signal or signal support structure may be mounted upon setting of the concrete.

DETAILED DESCRIPTION

Figure 1:
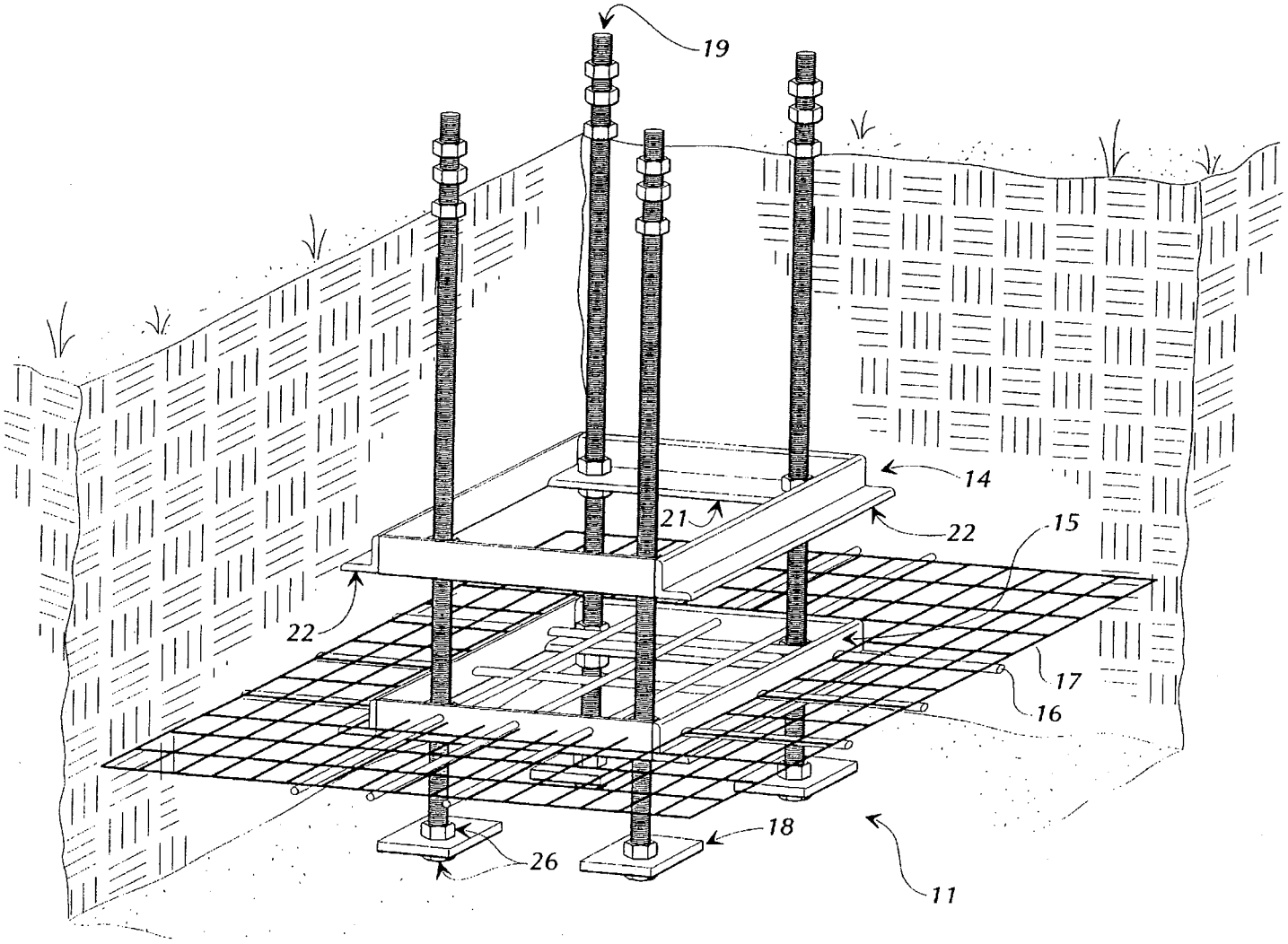
FIG. 1 is a perspective view of an anchoring and reinforcement framework for a railroad crossing signal foundation shown assembled in a hole preparatory to the pouring of concrete therein.

With reference to FIG. 1, there is shown a metallic framework 11 comprising four threaded guide rods 19 with a footing 18 mounted to the lower end of each guide rod. A lower frame member 15 and an upper frame member 14 are also mounted to the guide rods. Nuts 26 hold the footings, the lower frame member and the upper frame member in place upon the guide rods.

The footings 18 are each in the form of a flat square metal piece with a central opening through which a guide rod 19 extends. The upper frame member 14 and the lower frame member 15 are each comprised of four angle iron sides welded together at their distal ends to form a square. The frames thus have an L-shaped cross section with an upright leg and a laterally extending leg. On two opposing sides of each frame, the laterally extending legs 22 extend outwardly. On the other two opposing sides of each frame, the laterally extending legs 21 extend inwardly. The laterally extending legs 21 have openings which receive the guide rods 19. Each upright leg of each side of the lower frame member has openings which receive the hanger rods 16. Six hanger rods in this illustrated present embodiment support four segments of wire mesh 17 on the lower frame member. Unshown plastic ties secure the wire mesh to the hanger rods.

The hole for the foundation is dug in the ground in the shape and width desired for that of the in-situ formed foundation itself with a generally level floor. The framework as shown in FIG. 1 is usually assembled prior to being lowered into the hole with the exception of the segmented wire mesh 17. The framework is lowered centrally into the hole bringing footings 18 to rest upon the hole floor.

The upper frame member 14 is adjusted either up or down on the guide rods to a desired concrete fill plane position by threadedly raising or lowering the nuts 26 that straddle it on the guide rods. Similarly, the lower frame member 15 is adjusted either up or down on the guide rods by raising or lowering the nuts 26 to position the lower frame member usually midway between the upper frame member and the footings. For larger foundations, more than one lower frame member with reinforcement wire mesh may be used.

Once the upper and lower frame members are adjusted to their desired positions, concrete is poured into the hole to the top edge of the upper frame member which serves as a sight fill plane. The top surface of the concrete is then smoothed along the fill plane and allowed to set as shown in FIG. 3.

Figure 3:
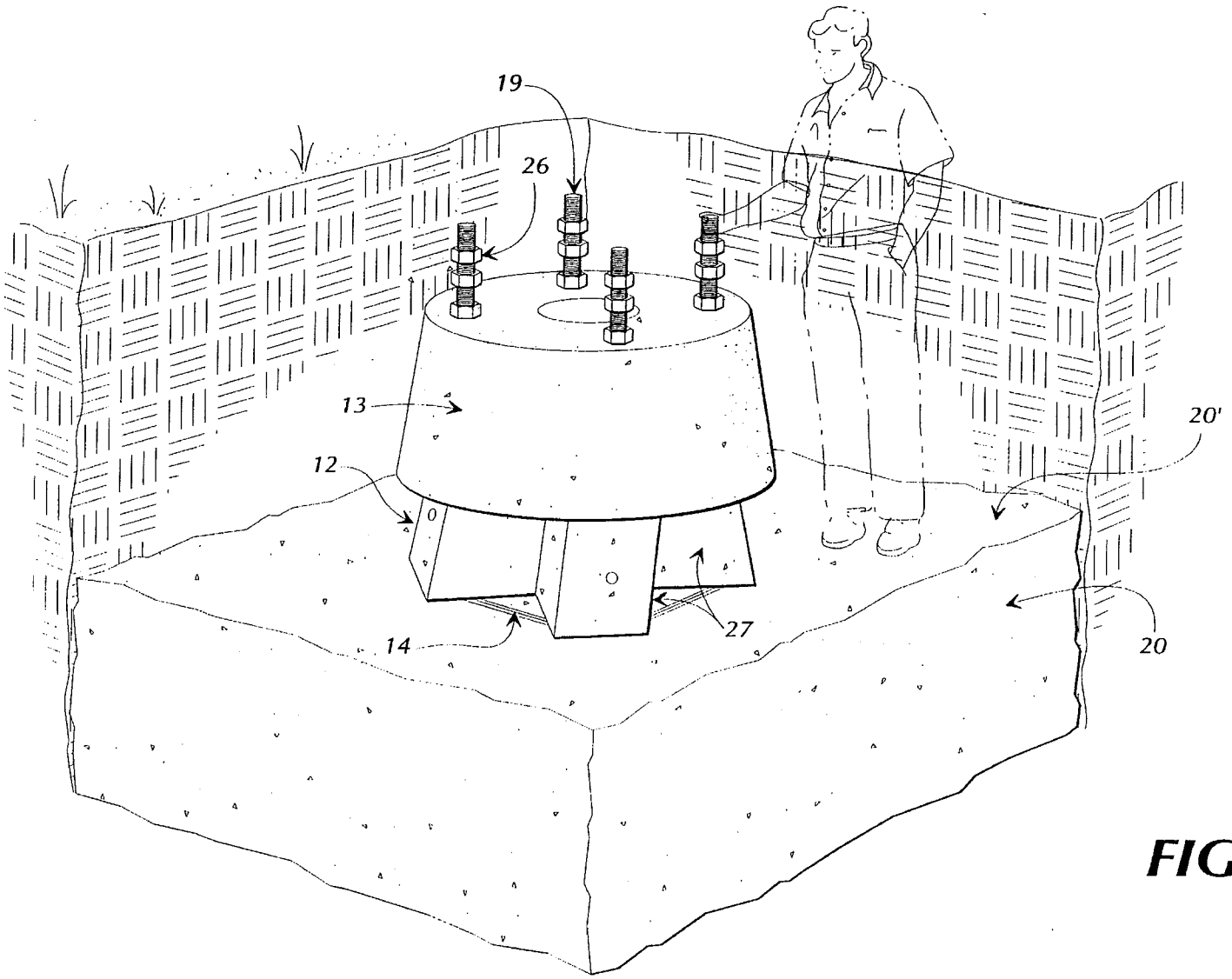
FIG. 3 is perspective view of the railroad crossing signal foundation with a pillar and crown mounted thereon.

About an hour after the concrete has begun to set, the pillar 12 and the crown 13 can be placed on the guide rods on top of the upper frame member 14 as shown in FIG. 3. The pillar 12 here is comprised of two conventional, interlocking, steel reinforced, concrete spider blocks 27 mounted transversely to each other in log-cabin fashion. As shown in FIG. 3, they are substantially smaller than the top surface 20' of the in-situ formed concrete block 20. Thus, ample space is provided for a worker to walk about the pillar and the crown upon surface 20' as they are mounted.

After the pillar and the crown are mounted and the worker has left, dirt is back-filled onto the foundation and against the pillar and crown with normally only an upper portion of the crown remaining exposed. The foundation is now ready to receive railroad crossing signal or traffic control equipment mounted atop it to the guide rods.

In a preferred embodiment, the hole is cube-shaped with a width of approximately 6½ feet and a depth of approximately 5 feet below the crown center of the adjacent road. However, the hole may be of different shapes and sizes as the terrain and load size dictate. The preferred location of the upper frame member on the guide rods is approximately 30 inches from the bottom of the hole. However, the location of the upper frame member on the guide rods may be adjusted to suit the height of the railroad crossing signal or signal support structure that is mounted to the guide rods so long as a portion of the guide rods remains exposed such that a railroad crossing signal or other structure may be mounted thereon. Where the extension of the guide rods above the crown is uneven due to the terrain or other obstacles, the guide rods may be cut to uniform length prior to affixing a railroad crossing or traffic signal thereto.

Figure 2:
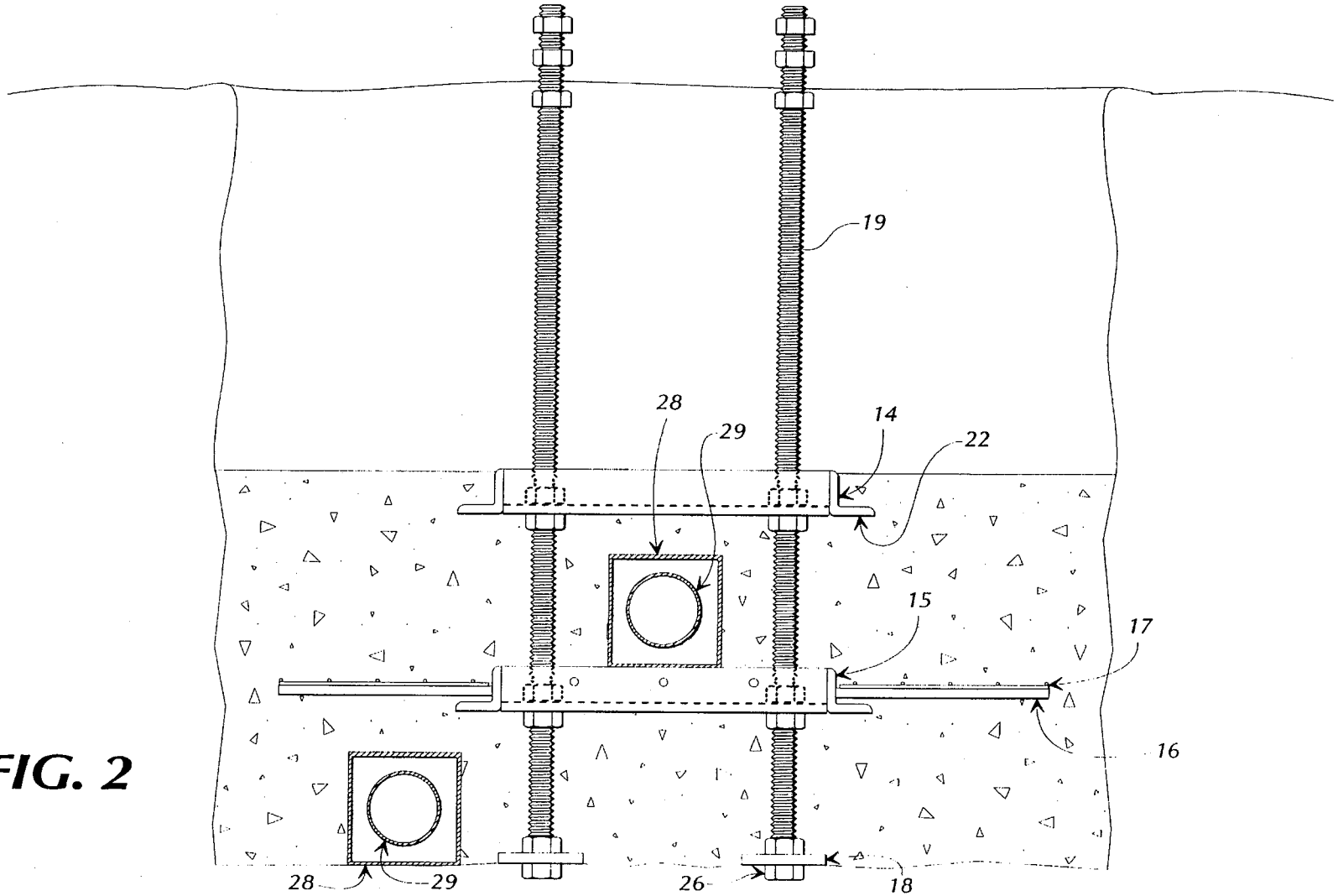
FIG. 2 is a view of the anchoring and reinforcement framework shown in FIG. 1 with concrete formed thereabout.

In some instances, obstructions may be unearthed in initially digging the hole for the foundation. Such a situation is shown in FIG. 2 where two pipes 29 traverse the hole at different elevations. These pipes are protected by placing wood shields 28 about them. For the lower pipe here, the protective shield is supported directly on the hole floor. For the upper pipe, the protective shield is erected to rest on the lower frame member 15. Thus, the lower frame member not only serves to support the hanger rods 16 and the wire mesh 17, but it also serves to support the protective shield here. After the protective shields are erected, concrete is poured without damage or rupture to the pipes and with the pipes remaining capable of being serviced or replaced without having to break up the concrete.

Since the framework of the foundation bears the weight of the pillar and the crown directly on the floor of the hole, the pillar and the crown can be mounted onto the foundation prior to the concrete fully setting and without the risk of the pillar or crown or other structure sinking into the concrete associated with the prior art. Since the new foundation can be constructed and the hole back-filled in approximately four hours, the new foundation also overcomes the problem of lengthy construction time associated with the prior art.

Additionally, since the hole for the foundation does not remain open for an extended period of time, the new foundation reduces the danger of physical injuries to passersby associated with the prior art. Moreover, since the setting concrete is no longer exposed to the outside elements for an extended period of time, natural complications such as icing in freezing climates are greatly diminished.

The new foundation invention also overcomes the problems of rotting of wood molding frames as well as the crumbling of adjacent earth walls associated with the prior art since no wood is needed in the new foundation. This in turn eliminates the need for removal of wood molding frames in poured concrete foundations once the concrete has set. Furthermore, unlike the prior art, the new foundation can be easily and adaptably constructed about preexisting underground obstacles without causing damage or interference to them.

It thus is seen that a new railroad crossing signal and traffic control foundation, and a new method of producing and erecting such, is now provided that overcomes problems long associated with those of prior art. It should be understood however that many modifications, additions and deletions may be made thereto without departure from the spirit and scope of the invention as set forth in the following claims.

I claim:

1. A method of constructing a railroad crossing signal foundation comprising the steps of:

(a) digging a hole in the ground adjacent a railroad crossing;

(b) mounting a metallic anchoring and reinforcing framework having guide rods and an upper frame member adjustably mounted to the guide rods along the length of the guide rods in the hole with the guide rods extending uprightly;

(c) adjustably moving the upper frame member to define a concrete fill plane; and (d) pouring concrete into the hole to the fill plane to substantially embed the framework in the concrete leaving a portion of the guide rods extending above the fill plane exposed to which a railroad crossing signal or signal support may be mounted upon setting of the concrete.

2. The method of constructing a railroad crossing signal foundation as set forth in claim 1, wherein step (b) a lower frame member of the framework is positioned at a desired location on the guide rods, hanger rods are mounted upon the lower frame member, and a wire mesh is mounted upon the hanger rods.

3. A method of constructing a foundation for the support of a load, such as a railroad crossing signal or signal support structure, where a preexisting utility pipe or line is located in the ground at the construction site, and wherein the method comprises the steps of:

(a) digging a hole in the ground to unearth a length of pipe in the hole;

(b) erecting a protective shield around the pipe within the hole;

(c) mounting a metallic anchoring and reinforcing framework having guide rods and a lower frame member adjustably mounted to the guide rods for movement along the length of the guide rods, the guide rods being positioned on the floor of the hole adjacent the pipe with a portion of the guide rods extending uprightly above a selected concrete fill plane;

(d) adjusting the lower frame member to a position supporting the protective shield, and (e) pouring concrete into the hole about the shield to the fill plane thereby substantially embedding the framework and the shielded pipe in the concrete and leaving a portion of the guide rods extending above the fill plane exposed to which a load may subsequently be mounted.

4. The method of constructing a railroad crossing signal foundation as set forth in claim 3, wherein step (c) an upper frame member of the framework is positioned at a desired location on the guide rods to define the concrete fill plane.

5. The method of constructing a railroad crossing signal foundation as set forth in claim 4, wherein step (c) hanger rods are mounted upon the lower frame member, and a wire mesh is mounted upon the hanger rods.

6. The method of constructing a railroad crossing signal foundation as set forth in claim 4 wherein the upper frame member is movably mounted to the guide rods for generally vertical relative movement along the guide rods.

7. A railroad crossing signal foundation comprising:

a plurality of upright guide rods;

an upper frame member mounted on said guide rods;

means for adjustably mounting said upper frame member to at least one said upright guide rods for generally vertical relative movement along said guide rods;

a lower frame member mounted on said guide rods below said upper frame member;

a concrete reinforcement gridwork supported on one said frame member; and a concrete block substantially embedding said upper frame member, said lower frame member, said concrete reinforcement gridwork and a lower portion of said guide rods that extend below said upper frame member.

8. The railroad crossing signal foundation of claim 7 wherein said concrete reinforcement gridwork comprises a plurality of hanger rods mounted to said lower frame member and extending laterally from said lower frame member; and a wire mesh supported by said hanger rods.

9. An anchoring and reinforcement framework for a railroad crossing signal foundation, adapted to support a railroad crossing signal or signal support thereon, comprising:

a plurality of guide rods having feet at their lower ends;

an upper frame member adjustably mounted on said guide rods for generally vertical movement along said guide rods to provide a selected concrete fill plane;

a lower frame member adjustably mounted on said guide rods; and a concrete reinforcement gridwork supported on said lower frame member, whereby the framework may be mounted uprightly in a hole in the ground with the feet of the guide rods supported on the hole floor, with the upper frame member adjusted on the guide rods to a desired fill plane position, with the lower frame member adjusted on the guide rods to a desired concrete reinforcement position for the gridwork, and with the guide rods extending above the fill plane exposed for the mounting of a railroad crossing signal or signal support structure thereon.

10. The anchoring and reinforcement framework of claim 9 wherein said concrete reinforcement gridwork further comprises a plurality of hanger rods mounted to said lower frame member and extending laterally from said lower frame member; and a wire mesh supported by said hanger rods.

11. The anchoring and reinforcement framework of claim 9 in combination with a pillar mounted upon said framework having a plurality of concrete pillar blocks through which said guide rods extend.

12. The anchoring and reinforcement framework of claim 11 in combination with a crown mounted upon said pillar through which said guide rods extend.

* * * * *